US011502427B2

(12) United States Patent
Zhang et al.

(10) Patent No.: US 11,502,427 B2
(45) Date of Patent: Nov. 15, 2022

(54) LOW PROFILE DUAL-FREQUENCY ANTENNA DEVICE

(71) Applicant: Molex, LLC, Lisle, IL (US)

(72) Inventors: Chun Xia Zhang, Shanghai (CN); Ping Zhang, Shanghai (CN); Guang-Yong Zhong, Shanghai (CN); Xue Tian Zhao, Shanghai (CN); Hai Liu, Shanghai (CN); Kang Cheng, Shanghai (CN); Qian Gao, Shanghai (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/320,738

(22) Filed: May 14, 2021

(65) Prior Publication Data

US 2021/0359428 A1 Nov. 18, 2021

(30) Foreign Application Priority Data

May 14, 2020 (CN) ..... 202010407138.9

(51) Int. Cl.
*H01Q 21/30* (2006.01)
*H01Q 21/06* (2006.01)
*H01Q 1/22* (2006.01)

(52) U.S. Cl.
CPC ..... *H01Q 21/30* (2013.01); *H01Q 1/2291* (2013.01); *H01Q 21/064* (2013.01)

(58) Field of Classification Search
CPC .... H01Q 21/30; H01Q 21/064; H01Q 1/2291; H01Q 5/385; H01Q 5/28; H01Q 13/16;
(Continued)

(56) References Cited

FOREIGN PATENT DOCUMENTS

EP 0923156 A1 6/1999
KR 20160142892 * 12/2006 ..... H01Q 13/10
(Continued)

OTHER PUBLICATIONS

Office Action received for KR Application No. 10-2021-0060626, dated May 24, 2022, 9 pages (5 pages of English translation and 4 pages of Official copy).

*Primary Examiner* — Hoang V Nguyen

(57) ABSTRACT

A low profile dual-frequency antenna device comprises an insulative carrier having a first surface and a second surface which are opposite and a conductor unit, the conductor unit comprises a first conductor which is provided to the first surface and a second conductor which is provided to the second surface and connected with the first conductor, a first radiation slot as a low frequency slot antenna is formed between the first conductor and the second conductor, the first conductor is formed with a second radiation slot, a third radiation slot which is communicated with the first radiation slot and the second radiation slot, a fourth radiation slot and a fifth radiation slot, and the third radiation slot, the fourth radiation slot and the fifth radiation slot together constitute a high frequency slot antenna, the second radiation slot decides an impedance and a resonance frequency width of each antenna, a first side edge and a second side edge is oppositely positioned at a location where the second radiation slot and the third radiation slot are communicated, the first conductor has a signal feeding-in portion thereon close to the first side edge, the first conductor has a ground portion thereon close to the second side edge.

9 Claims, 12 Drawing Sheets

(58) Field of Classification Search
CPC ..... H01Q 13/18; H01Q 13/10; H01Q 1/48; H01Q 21/24
See application file for complete search history.

(56) References Cited

FOREIGN PATENT DOCUMENTS

| | | | | | |
|---|---|---|---|---|---|
| KR | 20070081960 | A | | 8/2007 | |
| KR | 20090100866 | | * | 9/2009 | ..... H01Q 1/38 |
| KR | 20120094505 | A | | 8/2012 | |
| TW | 200910689 | A | | 3/2009 | |
| TW | 201230492 | A | | 7/2012 | |

* cited by examiner

LOW PROFILE DUAL-FREQUENCY ANTENNA DEVICE

RELATED APPLICATIONS

This application claims priority to Chinese Patent Application No. 202010407138.9, filed on May 14, 2020, the entirety of which is incorporated herein by reference.

TECHNICAL FIELD

The present disclosure relates to an antenna, and particularly relates to a low profile dual-frequency antenna device applied to a metal surface.

BACKGROUND

With the increasing popularity of Internet of Things products, WiFi antennas are widely applied to various Internet of Things products or fields, such as smart homes, smart home appliances, in-vehicle systems, industrial applications and the like. In the face of consumers' preference for a product with a metal surface texture, higher requirement has been imposed on an antennas applied to a metal environment. The WiFi antennas can be divided into 2.4 GHz single-frequency antenna and 2.4 G and 5 GHz dual-frequency antenna according to operating frequency thereof. Among the WiFi antennas, a 2.4 GHz single-frequency antenna which can be applied to a metal surface is currently on the market, this 2.4 GHz single-frequency antenna is easily affected by a length of a radio frequency signal transmission line and a disposing position of this 2.4 GHz single-frequency antenna, which makes the radiation performance of the antenna very unstable, but a 2.4 G and 5 GHz dual-frequency antenna which can be applied to the metal surface is currently not available. Therefore, it is necessary to design a dual-frequency antenna which operates at 2.4 G and 5 GHz frequency bands, can be applied to the metal surface and also has stable radiation performance.

SUMMARY

Therefore, an object of the present disclosure is to provide a low profile dual-frequency antenna device which operates at 2.4 G and 5 GHz frequency bands, can be applied to a metal surface and has high radiation performance and good stability at the operating frequency bands.

Accordingly, a low profile dual-frequency antenna device of the present disclosure comprises an insulative carrier and a conductor unit. The insulative carrier has a first surface and a second surface which are opposite. The conductor unit is provided on the insulative carrier and comprises a first conductor and a second conductor, the first conductor is provided to the first surface, the second conductor is provided to the second surface and is connect with the first conductor, a first radiation slot is formed between the first conductor and the second conductor, extends along an edge of the insulative carrier and encircles a periphery of the first conductor; and the first conductor is formed with a second radiation slot, a third radiation slot which is communicated with the first radiation slot and the second radiation slot, a fourth radiation slot and a fifth radiation slot; the first radiation slot is capable of resonating at a low frequency band to constitute a low frequency slot antenna, the third radiation slot, the fourth radiation slot and the fifth radiation slot are capable of resonating at a high frequency band to together constitute a high frequency slot antenna, the second radiation slot decides an impedance and a resonance frequency width of the low frequency slot antenna and an impedance and a resonance frequency width of the high frequency slot antenna; and a first side edge and a second side edge are oppositely positioned at a location where the second radiation slot and the third radiation slot are communicated, and the first conductor has a signal feeding-in portion thereon close to the first side edge, the first conductor has a ground portion thereon close to the second side edge.

In some embodiments of the present disclosure, the insulative carrier is rectangular to have four side surfaces which connect the first surface and the second surface, and the conductor unit further comprises a connection conductor, the connection conductor is provided to one side surface of the four side surfaces which is close to the second side edge, and the connection conductor connects the first conductor and the second conductor.

In some embodiments of the present disclosure, the second conductor further comprises at least one extension portion which extends from the second surface to at least one side surface of the three side surfaces except the one side surface providing the connection conductor.

In some embodiments of the present disclosure, the second conductor further comprises three extension portions which respectively extend from the second surface to the three side surfaces except the one side surface providing the connection conductor, a first extension slot is formed between every two adjacent extension portions and is communicated with the first radiation slot, a second extension slot is formed between the connection conductor and each of the extension portions adjacent to the connection conductor and is communicated with the first radiation slot, and the low frequency slot antenna comprises the first extensions slot and the second extension slots.

In some embodiments of the present disclosure, the second conductor further comprises three extension portions which respectively extend from the second surface to the three side surfaces except the one side surface providing the connection conductor, every two adjacent extension portions are connected with each other, and the connection conductor and each of the extensions portions adjacent to the connection conductor are connected with each other.

In some embodiments of the present disclosure, the low profile dual-frequency antenna device further comprises a radio frequency transmission line, the radio frequency transmission line comprises an inner conductor, an inner insulative layer, an outer conductor and an outer insulative layer which are provided from the inside to the outside, one end of the inner conductor is electrically connected with the signal feeding-in portion, one end of the outer conductor which is positioned at one same side of the radio frequency transmission line as the inner conductor is electrically connected with the ground portion, and the radio frequency transmission line further comprises a connection terminal provided to the other side of the radio frequency transmission line.

In some embodiments of the present disclosure, a length of the first radiation slot can decide a resonance frequency of the low frequency slot antenna, lengths of the third radiation slot, the fourth radiation slot and the fifth radiation slot can decide a resonance frequency of the high frequency slot antenna, a length and a width of the second radiation slot can decide an impedance and a resonance frequency width of the low frequency slot antenna and an impedance and a resonance frequency width of the high frequency slot antenna.

In some embodiments of the present disclosure, the low profile dual-frequency antenna device can be disposed on a metal surface by a manner that the first conductor is toward the up.

In some embodiments of the present disclosure, the low profile dual-frequency antenna device can be disposed in a metal box or a metal recessed groove by a manner that the first conductor is toward the up.

A technical effect of the present disclosure lies in that: by that the first radiation slot formed by the conductor unit provided on the insulative carrier constitutes the low frequency slot antenna, and by that the third radiation slot, the fourth radiation slot and the fifth radiation slot formed on the first conductor together constitute the high frequency slot antenna, the low frequency slot antenna and a low frequency radio frequency signal can generate resonance to transmit or receive the low frequency radio frequency signal, and the high frequency slot antenna and a high frequency radio frequency signal can generate resonance to transmit or receive the high frequency radio frequency signal, the low profile dual-frequency antenna device can achieve the technical effect and the object that the radio frequency signal at a high frequency band and the radio frequency signal at the low frequency band can be transmitted and received. And, the slot antennas of the low profile dual-frequency antenna device transmit and receive the radio frequency signal by self-resonance and are independent of the length of the radio frequency transmission line used to transmit the radio frequency signal or the disposing position of the low profile dual-frequency antenna device, so the radiation efficacy of the low profile dual-frequency antenna device will be not affected by the length of the radio frequency transmission line or the disposing position of the low profile dual-frequency antenna device; and the low profile dual-frequency antenna device may be directly disposed on a metal surface or a bottom surface of a metal recessed groove and the radiation efficacy of the low profile dual-frequency antenna device is not affected.

BRIEF DESCRIPTION OF THE DRAWINGS

Other features and effects of the present disclosure will be apparent from an embodiment illustrated in the drawings, in which.

DETAILED DESCRIPTION OF THE PREFERRED EMBODIMENTS

Figure 1:
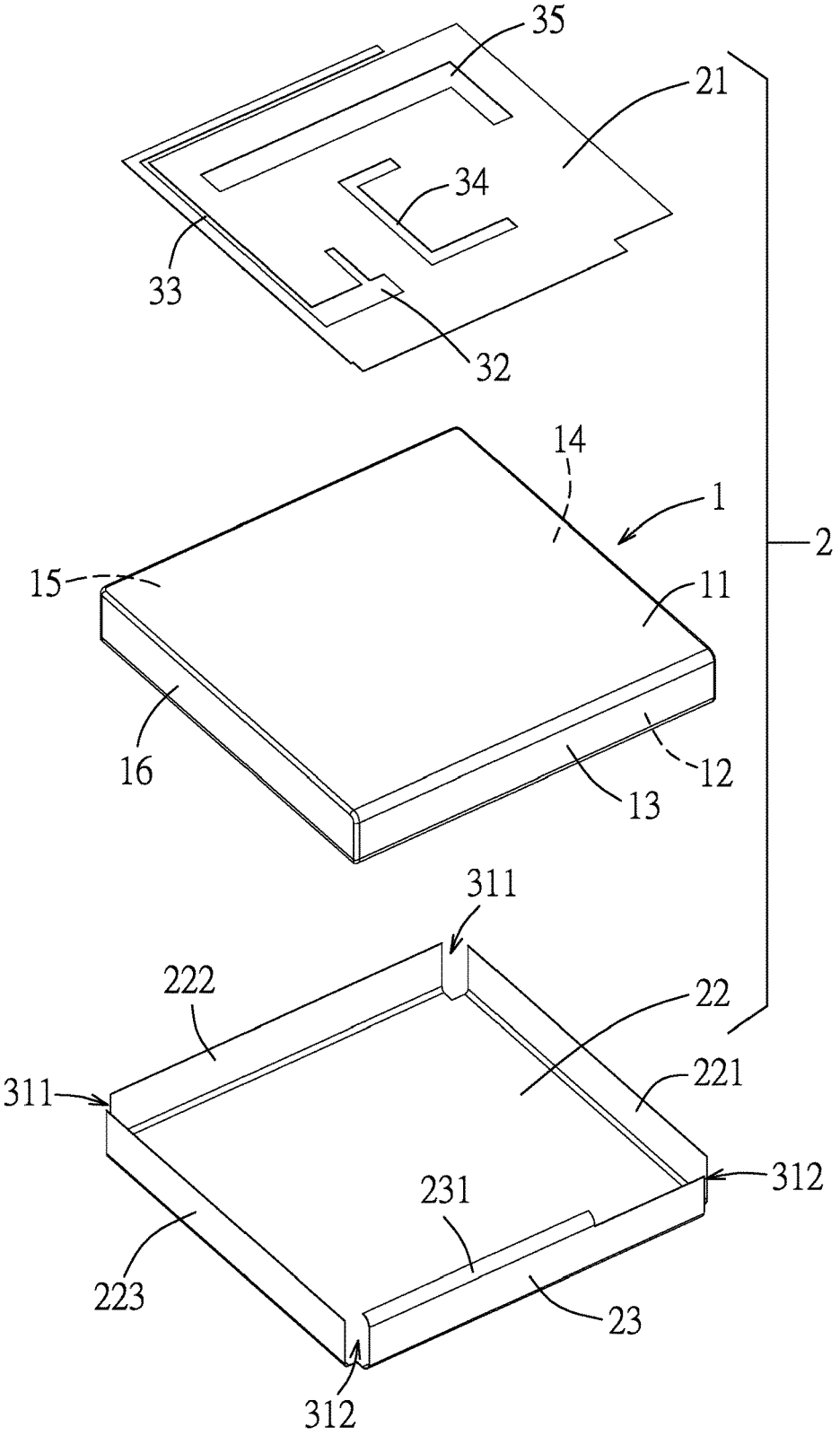
FIG. 1 is a perspective exploded structural schematic view of a first embodiment of a low profile dual-frequency antenna device of the present disclosure.

Before the present disclosure is described in detail, it should be noted that the similar components are indicated by the same reference numerals in the following description.

Figure 2:
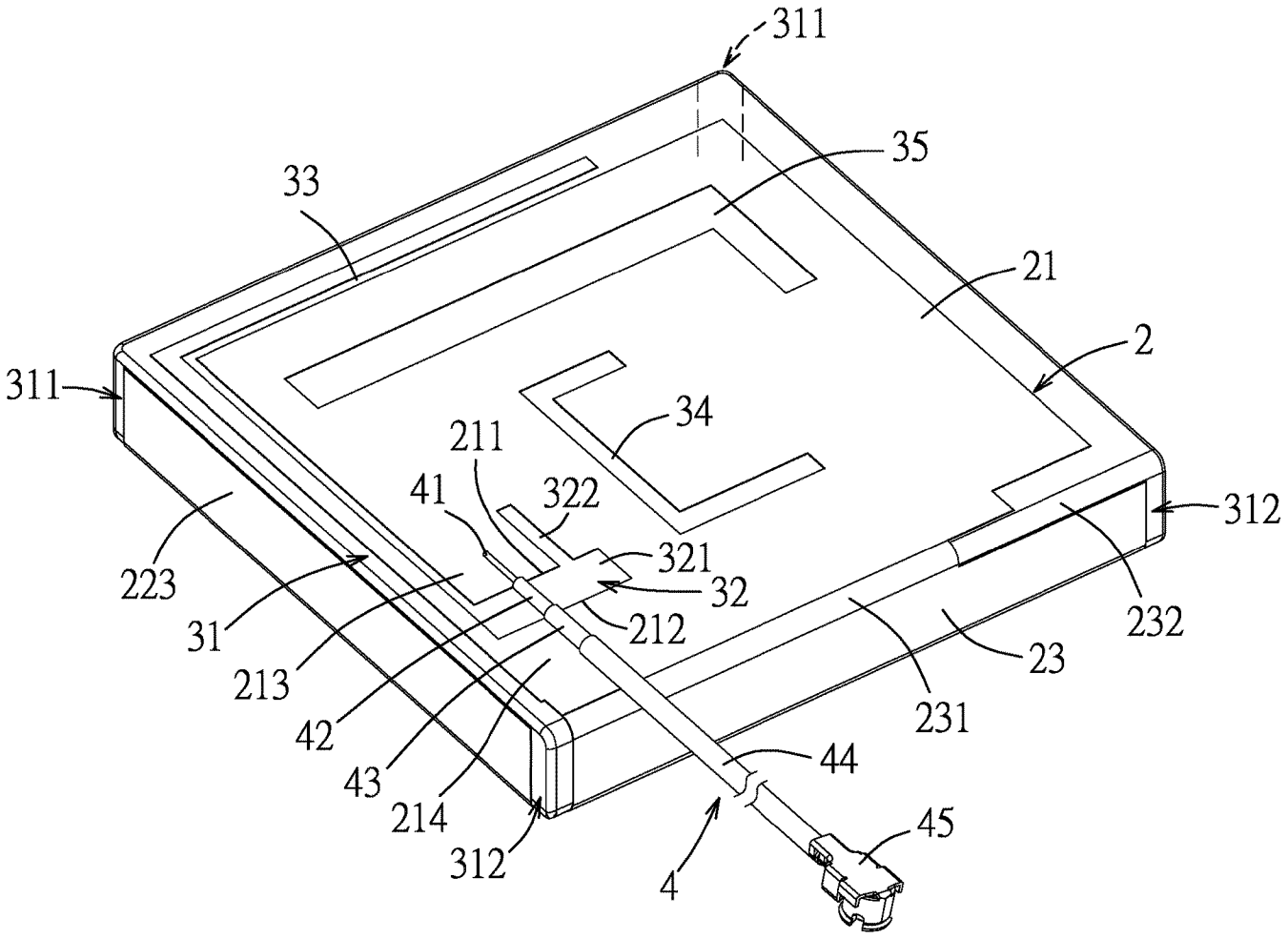
FIG. 2 is a perspective assembled structural schematic top view of the first embodiment.

Referring to FIG. 1 and FIG. 2, a first embodiment of a low profile dual-frequency antenna device of the present disclosure mainly includes an insulative carrier 1 and a conductor unit 2 provided on the insulative carrier 1. In the present embodiment, the insulative carrier 1 is rectangular, for example, cube or cuboid, and so has a first surface 11 and a second surface 12 which are opposite, and the insulative carrier 1 may be made from but is not limited to a plastic material which has a low dielectric constant and a low dielectric loss, so as to be beneficial to realize wide frequency band and high performance of antennas.

The conductor unit 2 is provided on the insulative carrier 1 and includes a first conductor 21 and a second conductor 22, the first conductor 21 is provided to the first surface 11, the second conductor 22 is provided to the second surface 12 and is connected with the first conductor 21 via a connection conductor 23, and a first radiation slot 31 is formed between the first conductor 21 and the second conductor 22, extend along an edge of the insulative carrier 1 and encircles a periphery of the first conductor 21; moreover, the first conductor 21 is further formed with a second radiation slot 32, a third radiation slot 33 which communicates the first radiation slot 31 and the second radiation slot 32, a fourth radiation slot 34 and a fifth radiation slot 35.

The first radiation slot 31 resonates at a low frequency band and thus constitutes a low frequency slot antenna, the third radiation slot 33, the fourth radiation slot 34 and the fifth radiation slot 35 resonate at a high frequency band and together constitute a high frequency slot antenna, and the second radiation slot 32 decides an impedance and a resonance frequency width of the low frequency slot antenna and an impedance and a resonance frequency width of the high frequency slot antenna.

Moreover, as shown in FIG. 2, a first side edge 211 and a second side edge 212 are oppositely positioned at a location where the second radiation slot 32 and the third radiation slot 33 are communicated, and the first conductor 21 has a signal feeding-in portion 213 thereon close to the first side edge 211, the first conductor 21 has a ground portion 214 thereon close to the second side edge 212. In addition, the conductor unit 2 may be metal or other conductive material, for example conductive material plasma, but the present disclosure is not limited thereto.

Therefore, when a low frequency radio frequency signal is fed-in by the signal feeding-in portion 213 and is grounded by the ground portion 214, and when an effective length of the low frequency slot antenna constituted by the first radiation slot 31 is equal to (equivalent to) ½ of a wavelength of the low frequency radio frequency signal, the low frequency slot antenna and the low frequency radio frequency signal will generate resonance to transmit the low frequency radio frequency signal. Similarly, when the effective length of the low frequency slot antenna is equal to (equivalent to) ½ of a wavelength of a low frequency radio frequency signal from the external, the low frequency slot antenna and the low frequency radio frequency signal from the external will generate resonance to receive the low frequency radio frequency signal from the external, and allow the low frequency radio frequency signal from the external to be fed-in the signal feeding-in portion 213.

Similarly, when a high frequency signal is fed-in by the signal feeding-in portion 213 and is grounded by the ground portion 214, when an effective length of the high frequency slot antenna constituted by the third radiation slot 33, the fourth radiation slot 34 and the fifth radiation slot 35 together is equal to (equivalent to) ½ of a wavelength of the high frequency radio frequency signal, the high frequency slot antenna and the high frequency radio frequency signal will generate resonance to transmit the high frequency radio frequency signal. Similarly, when the effective length of the high frequency slot antenna is equal to (equivalent to) ½ of a wavelength of a high frequency radio frequency signal from the external, the high frequency slot antenna and the high frequency radio frequency signal from the external will generate resonance to receive the high frequency radio frequency signal from the external, and allow the high frequency radio frequency signal from the external to be fed-in the signal feeding-in portion 213. Therefore, it achieves the technical effect and the object that the present embodiment can transmit and receive a radio frequency signal at the high frequency band and a radio frequency signal at the low frequency band.

Specifically, the insulative carrier 1 of the present embodiment further has four side surfaces 13, 14, 15 and 16 which connect the first surface 11 and the second surface 12, and the connection conductor 23 is provided to the side surface 13 of the side surfaces 13-16 which is close to the second side edge 212 so as to connect the first conductor 21 and the second conductor 22, and the connection conductor 23, the first conductor 21 and the second conductor 22 together form the first radiation slot 31 which extends along the edge of the insulative carrier 1 and encircles the periphery of the first conductor 21, and a length of the first radiation slot 31 may be adjusted by changing a length of a connection portion 231 of the connection conductor 23, the connection portion 231 connects the first conductor 21 and the connection conductor 23. For example, as shown in FIG. 2, when the connection portion 231 is lengthen, a slot 232 formed between the first conductor 21 and the connection conductor 23 is shorten, so a whole length of the first radiation slot 31 is shorten; conversely, when the connection portion 231 is shorten, the whole length of the first radiation slot 31 is lengthen. Moreover, the slot 232 is formed to a boundary between the first surface 11 and the side surface 13, but also may be formed to the first surface 11 or the side surface 13, and so the present disclosure is not limit to that as shown in FIG. 2.

The second radiation slot 32 has a wide portion 321 and a narrow portion 322, the wide portion 321 is rectangular and one end the wide portion 321 and one end of the third radiation slot 33 are communicated to form the first side edge 211 and the second side edge 212; the narrow portion 322 is an elongate groove which extends from a side edge of the wide portion 321 (the side edge of the wide portion 321 and the first side edge 211 are the same side edge) toward a direction away from the second side edge 212 and is perpendicular to the second side edge 212. And the first conductor 21, the second conductor 22 and the connection conductor 23 may be formed on the insulative carrier 1 by using Laser Direct Structuring (LDS), insert mold or patching and the like, but the present disclosure is not limited thereto.

In the present embodiment, the second conductor 22 further includes three extension portions 221, 222 and 223 which respectively extend from the second surface 12 to three side surfaces 14, 15 and 16 except the side surface 13, and the extension portions 221, 222 and 223 are not connected with each other, Therefore, one first extension slot 311 is formed between the adjacent extension portions 221 and 222 and communicated with the first radiation slot 31, and one first extension slot 311 is formed between the adjacent extension portions 222 and 223 and communicated with the first radiation slot 31, and the connection conductor 23 and each of the adjacent extension portions 221 and 223 are not connected with each other, one second extension slot 312 is formed between the connection conductor 23 and each of the adjacent extension portions 221 and 223 and communicated with the first radiation slot 31. Therefore, the first extension slots 311 and the second extension slots 312 are included in the first radiation slot 31 to be acted as a part of the low frequency slot antenna.

Figure 4:
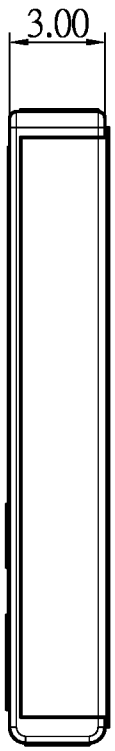
FIG. 3 and FIG. 4 illustrate dimensions of the first embodiment.
Figure 3:
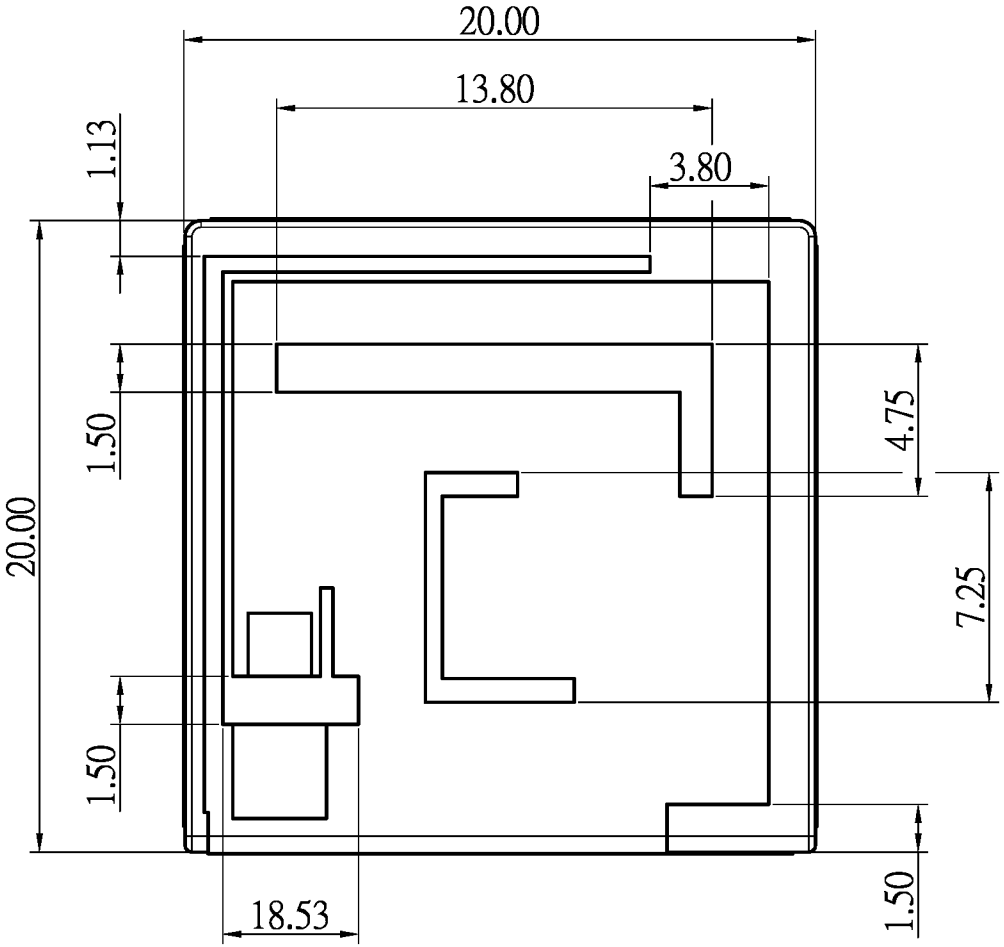

Specifically, the length of the first radiation slot 31 can decide a resonance frequency of the low frequency slot antenna, therefore, the present embodiment controls the resonance frequency of the low frequency slot antenna to be 2.4 GHz by properly adjusting the length of the first radiation slot 31, that is, the low frequency slot antenna can operate at a 2.4 GHz frequency band; it is noted that, the extension portions 221, 222 and 223 which respectively extend to the side surfaces 14, 15 and 16 each may further extend upwardly to the first surface 11 of the insulative carrier 1, so as to make a width of the first radiation slot 31 narrower to adjust the resonance frequency of the low frequency slot antenna. And the present embodiment controls the resonance frequency of the high frequency slot antenna to be 5 GHz by properly adjusting lengths of the third radiation slot 33, the fourth radiation slot 34 and the fifth radiation slot 35, that is, the high frequency slot antenna can operate at a 5 GHz frequency band. And the present embodiment can decide the impedance and the resonance frequency width of the low frequency slot antenna and the impedance and the resonance frequency width of the high frequency slot antenna by adjusting a length and a width of the second radiation slot 32. Therefore, when operating frequencies (the resonance frequencies) of the low profile dual-frequency antenna device of the present embodiment are at, for example, 2.4 GHz and 5 GHz, associated dimensions (unit: millimeter (mm)) are given as shown in FIG. 3 and FIG. 4.

In addition, as shown in FIG. 2, the low profile dual-frequency antenna device of the present embodiment further includes a radio frequency transmission line 4, the radio frequency transmission line 4 is a coaxial electrical cable and include an inner conductor 41, an inner insulative layer 42, an outer conductor 43 and an outer insulative layer 44 which are provided from the inside to the outside, one end of the inner conductor 41 is electrically connected with the signal feeding-in portion 213 of the first conductor 21 and the outer conductor 43 is electrically connected with the ground portion 214 of the first conductor 21, so as to feed-in a radio frequency signal to the conductor unit 2 or receive a radio frequency signal fed-in from the conductor unit 2. Moreover, the radio frequency transmission line 4 further includes a connection terminal 45 provided to the other end thereof, the connection terminal 45 can be connected with another apparatus (for example, a radio frequency signal generating or processing device) so as to feed-in a radio frequency signal outputted by the another apparatus to the conductor unit 2 or transmit a radio frequency signal fed-in the conductor unit 2 to the another apparatus. And, by adjusting the length and the width of the second radiation slot 32, the impedances of the antennas may be adjusted to match with an impedance of the radio frequency transmission line 4, so as to make that a radio frequency signal can be smoothly fed-in the conductor unit 2 via the radio frequency transmission line 4, and make that a radio frequency signal from the external can be smoothly fed-in the radio frequency transmission line 4 via the conductor unit 2.

Figure 5:
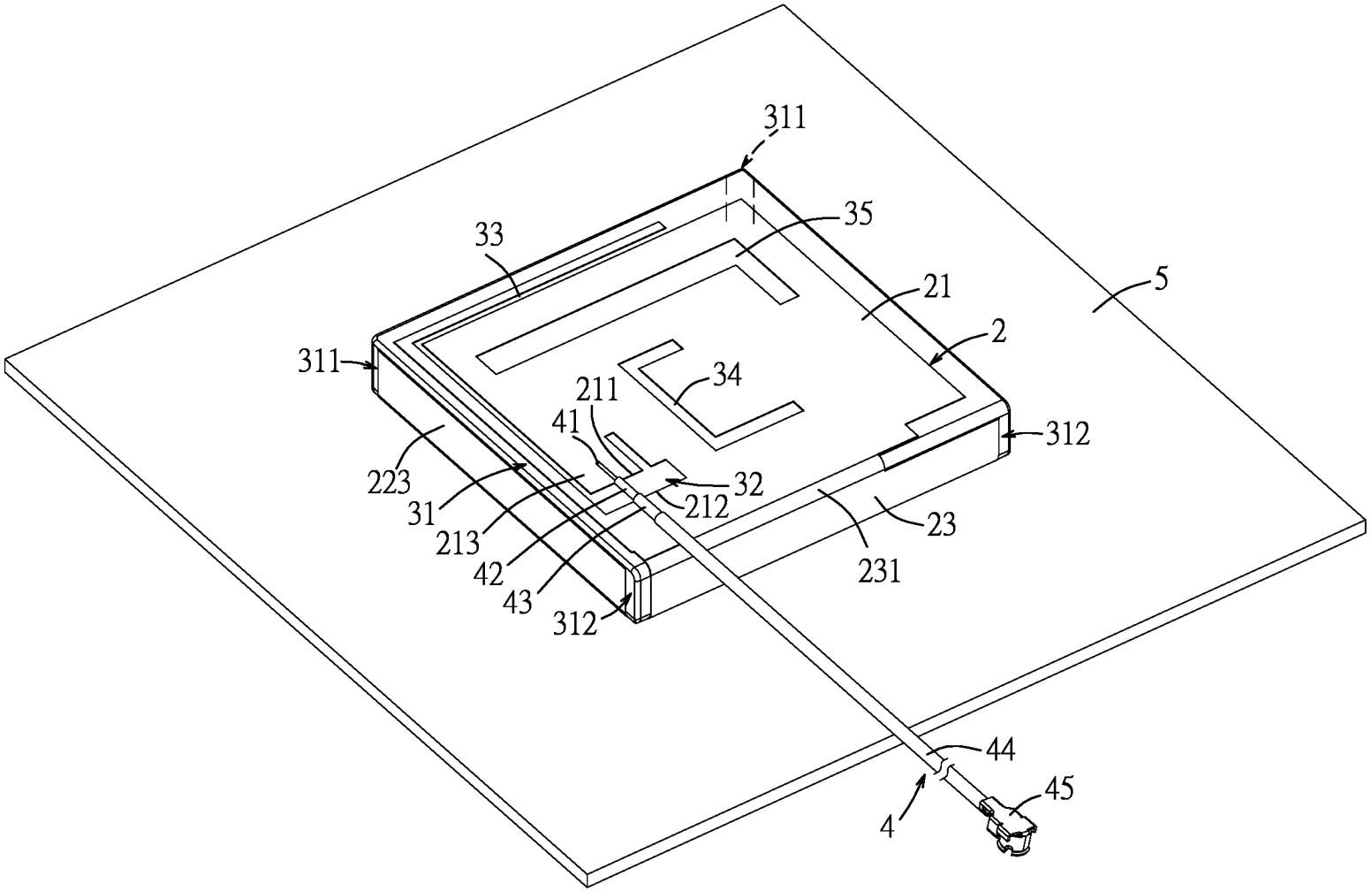
FIG. 5 is a schematic view of the first embodiment disposed on a surface of a metal plate.
Figure 6:
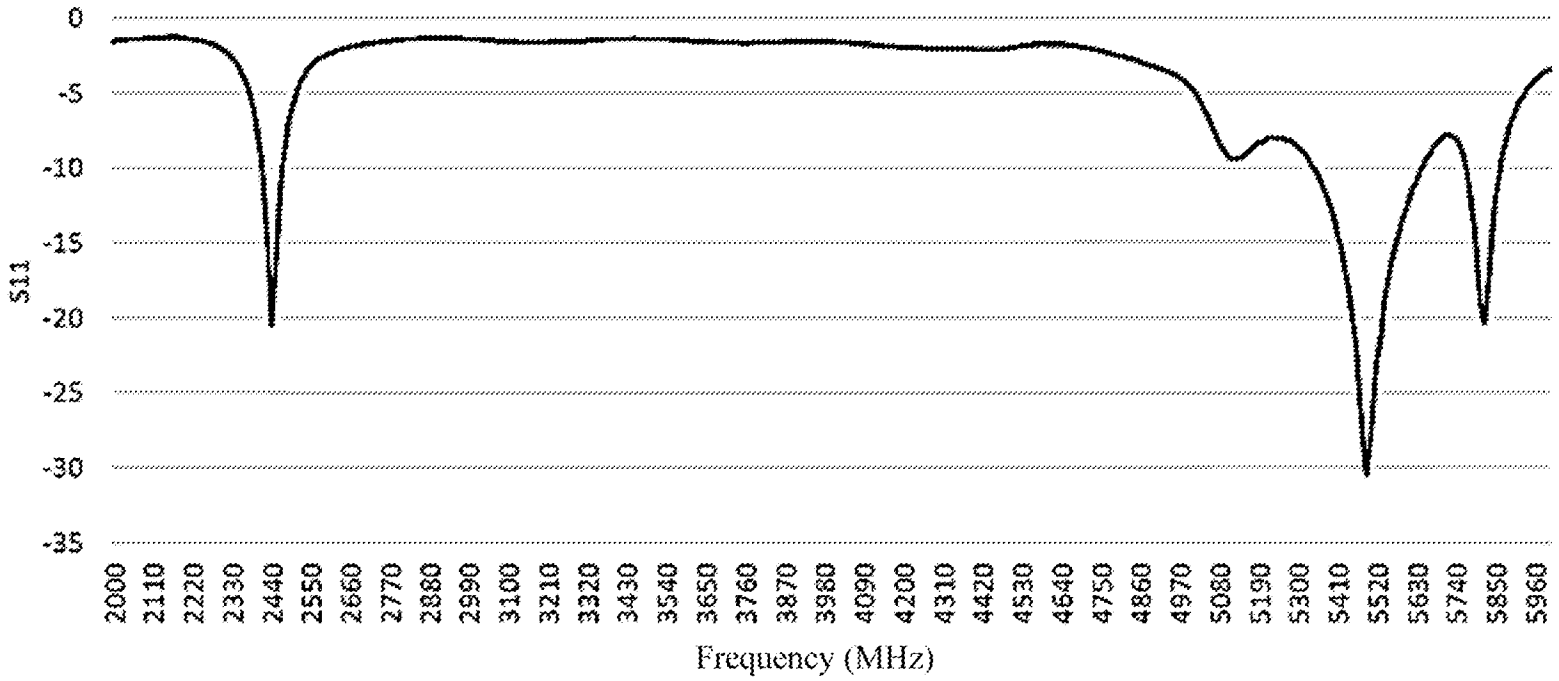
FIG. 6 illustrates return loss data of the first embodiment at operating frequency bands.
Figure 7:
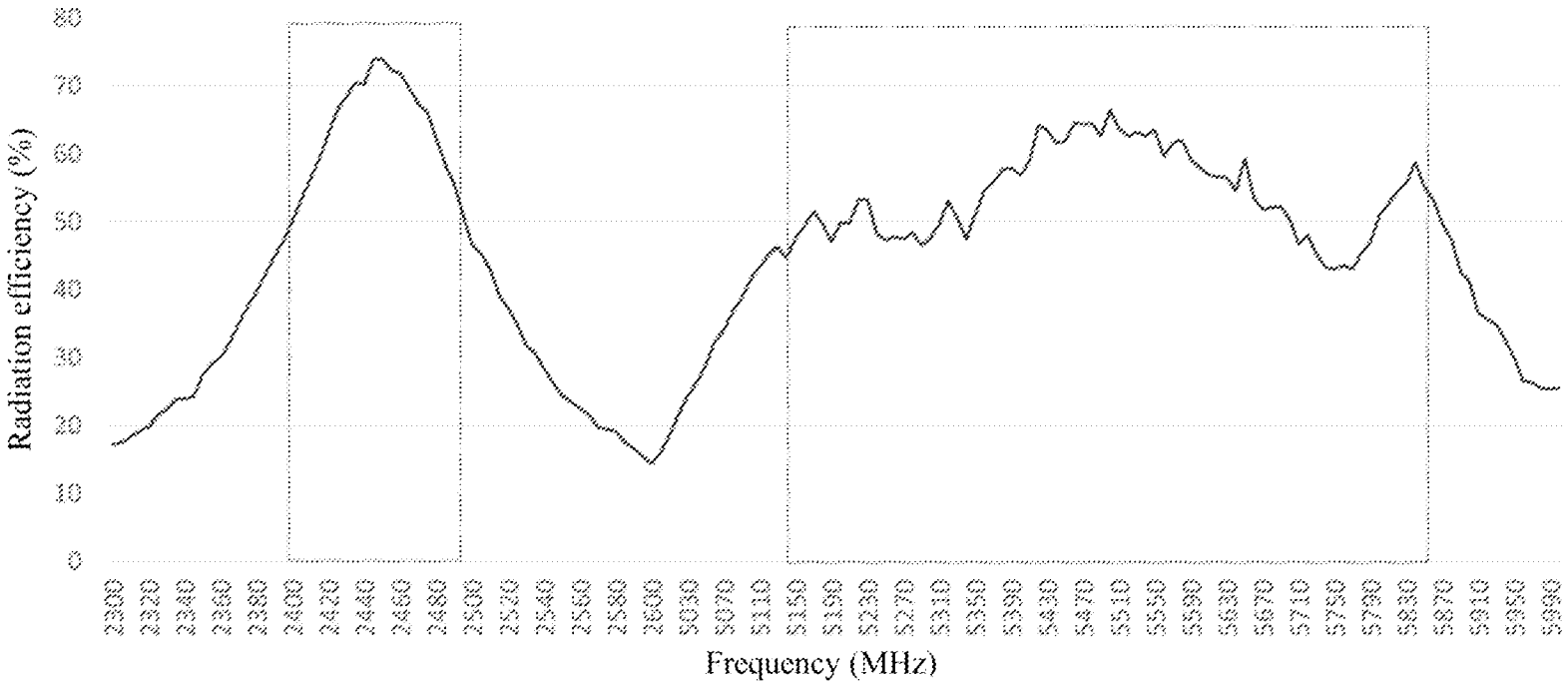
FIG. 7 illustrates radiation efficacy data of the first embodiment at the operating frequency bands.

As shown in FIG. 5, when the low profile dual-frequency antenna device of the present embodiment is disposed on a surface of a metal plate 5 by that the second surface 12 of the insulative carrier 1 is toward the down and a radio frequency signal is fed-in to the conductor unit 2 via the radio frequency transmission line 4, as can be seen from FIG. 6, when the frequency of the radio frequency signal is at 2440 MHz (that is 2.44 GHz), 5520 MHz (that is 5.22 GHz) and 5580 MHz (that is 5.58 GHz), a return loss of the low profile dual-frequency antenna device of the present embodiment is lowest, and a return loss at 2.4~2.5 GHz and 5.1~5.9 GHz frequency bands also is lower than −5 dB; and as shown in FIG. 7, FIG. 7 shows that, the low profile dual-frequency antenna device of the present embodiment maintains a certain radiation efficacy, for example 50% or more, at 2.4~2.5 GHz and 5.1~5.9 GHz frequency bands, it shows that, even the low profile dual-frequency antenna device of the present embodiment is disposed on a metal surface, the low profile dual-frequency antenna device of the present embodiment has comparable good radiation efficacy at the 2.4 GHz frequency band and the 5 GHz frequency band.

Figure 8:
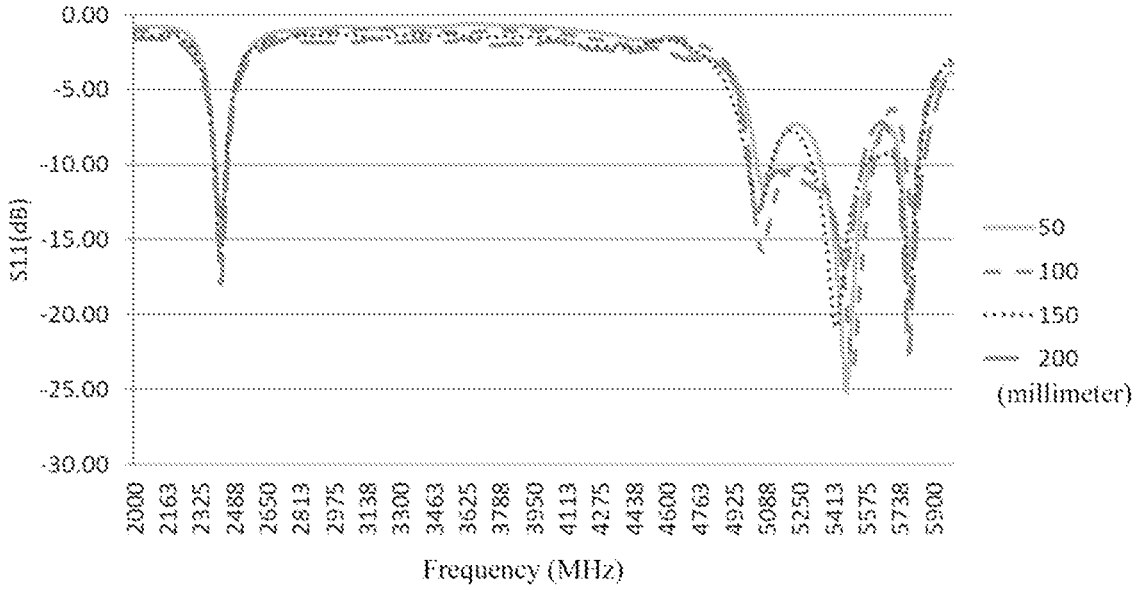
FIG. 8 illustrates radiation performance change of the first embodiment when the radio frequency transmission line has different lengths.
Figure 8:
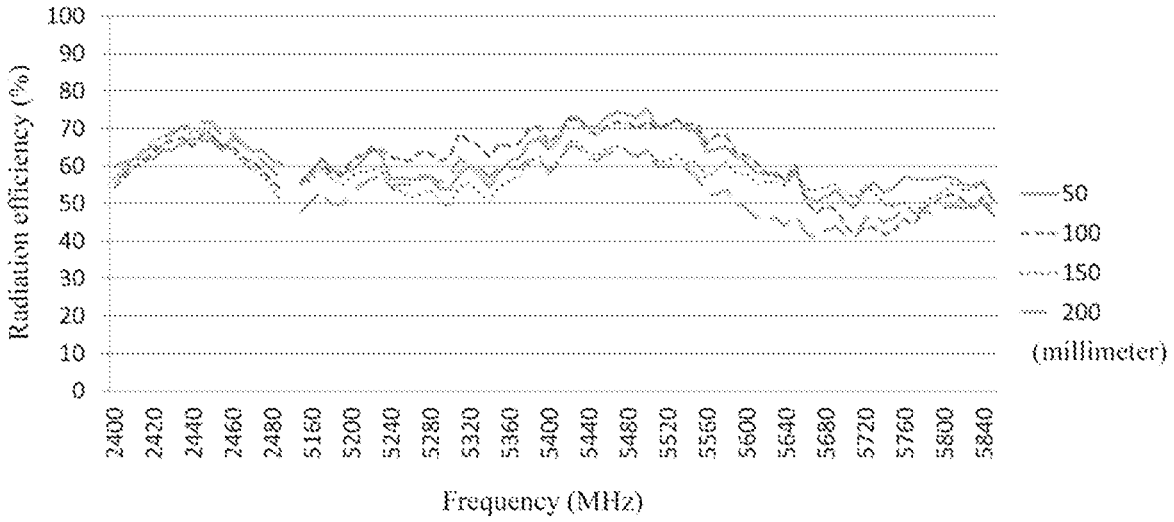

Further referring to FIG. 8, FIG. 8 shows that, when the radio frequency transmission line 4 has different lengths (for example, 50, 100, 150 and 200 millimeters), the return loss of the low profile dual-frequency antenna device of the present embodiment is low in the range of the resonance frequencies (the operating frequencies) (for example at 2.4~2.5 GHz and 5.1~5.9 GHz frequency bands) (at −5 dB or less), and the radiation efficacy change is not large and a certain radiation efficacy or more, for example 50% or more is maintained. As can be seen from this, when the radio frequency transmission line 4 has different lengths, the radio frequency transmission line 4 with the different lengths does not generate apparent effect on the radiation efficacy of the low profile dual-frequency antenna device of the present embodiment, because the antennas of the low profile dual-frequency antenna device of the present embodiment are slot antennas, which each generates resonance by a resonance cavity constituted by the slot formed on the conductor unit 2 with the radio frequency signal to transmit the radio frequency signal, so the radiation efficacy of the low profile dual-frequency antenna device of the present embodiment is independent of the length of the radio frequency transmission line 4, is not affected by the length of the radio frequency transmission line 4.

Figure 9:
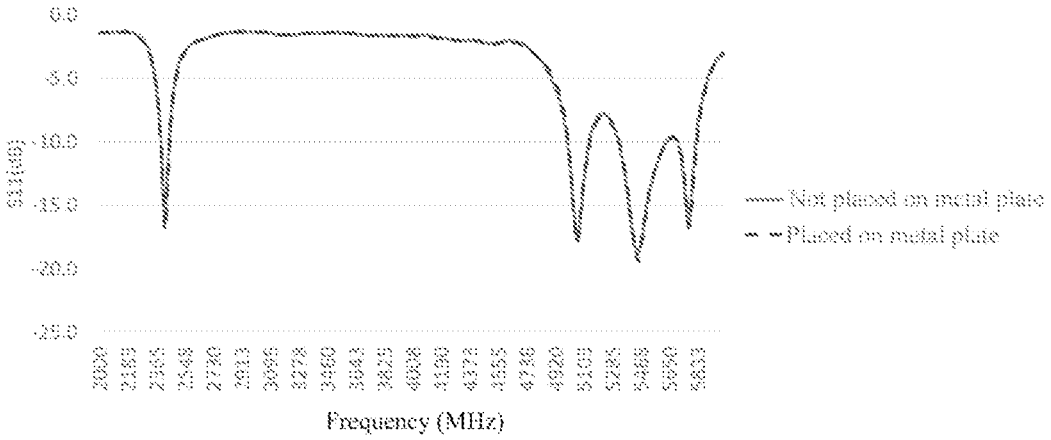
FIG. 9 illustrates radiation performance change of the first embodiment when the radio frequency transmission line is disposed at different positions.
Figure 9:
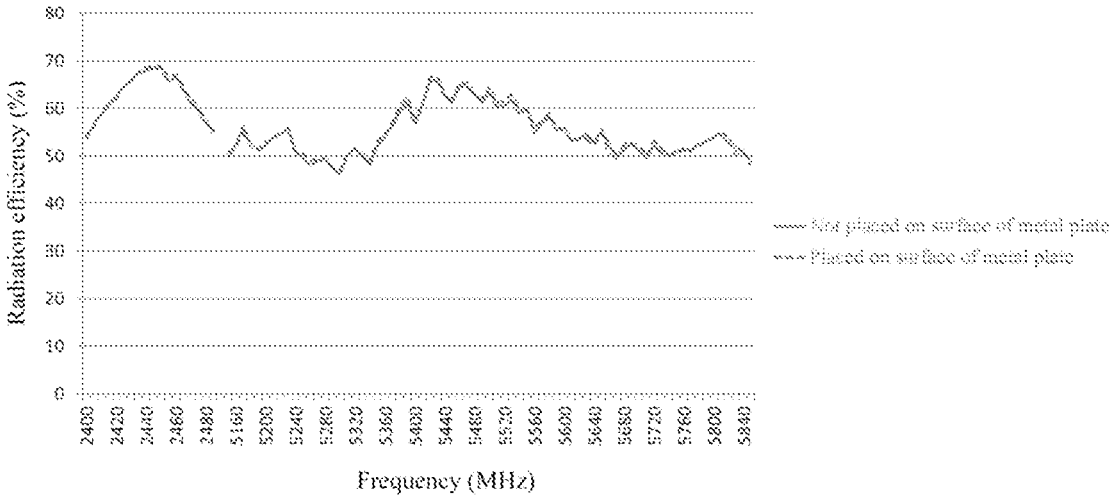

Further referring to FIG. 9, FIG. 9 shows that, when the radio frequency transmission line 4 is not disposed on the surface of the metal plate 5 and when the radio frequency transmission line 4 is disposed on the surface of the metal plate 5, the return loss of the low profile dual-frequency antenna device of the present embodiment in the resonance frequencies (the operating frequencies) range (for example at 2.4~2.5 GHz and 5.1~5.9 GHz frequency bands) is low and the radiation efficacy is not apparently affected. Because of the above, the low profile dual-frequency antenna device of the present embodiment is to generate resonance by a resonance cavity constituted by the slot formed on the conductor unit 2 with the radio frequency signal to transmit the radio frequency signal, so the radiation efficacy of the low profile dual-frequency antenna device of the present embodiment is independent of the disposing position of the radio frequency transmission line 4, is not affected by the disposing position of the radio frequency transmission line 4.

Figure 10:
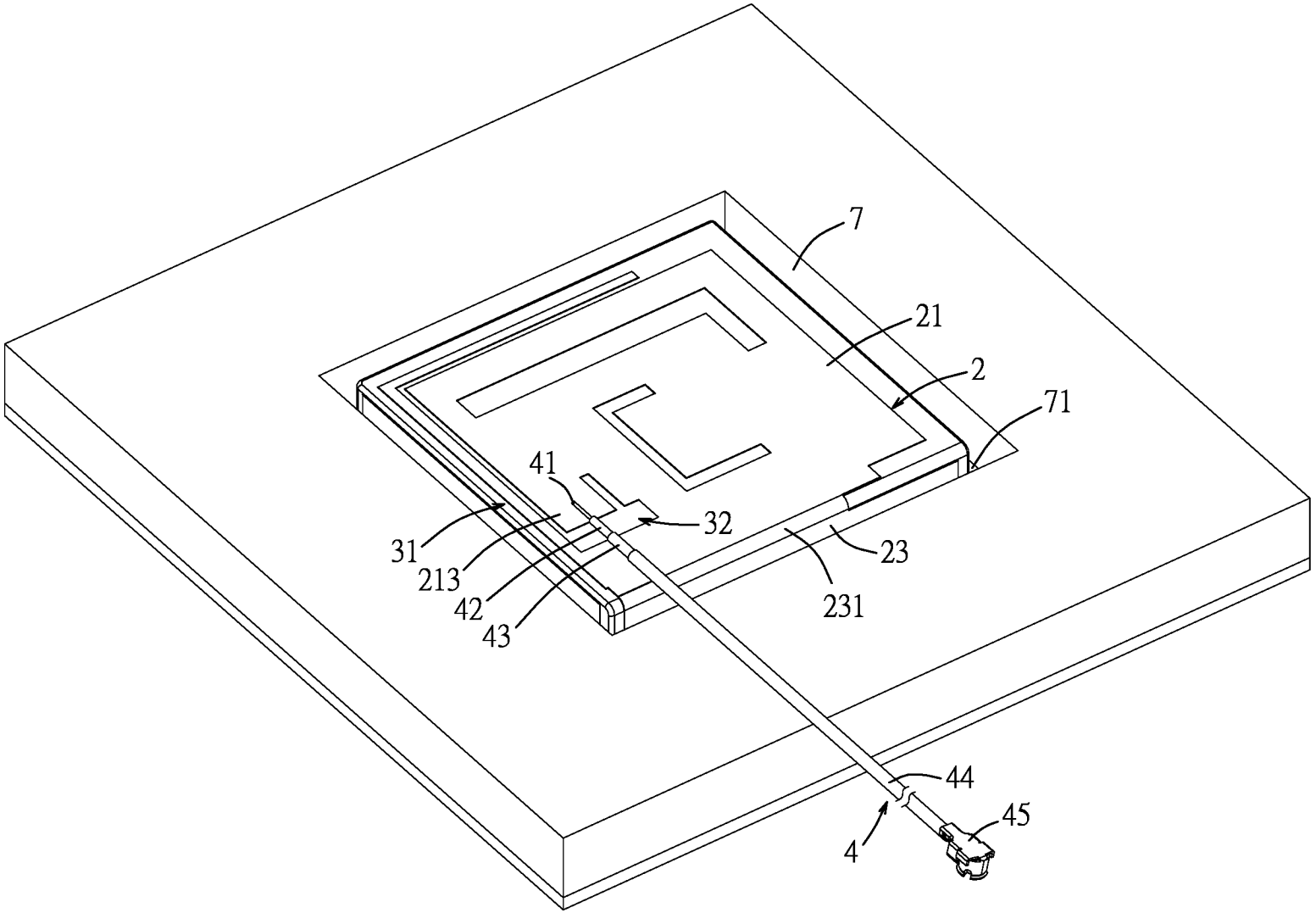
FIG. 10 is a schematic view of the first embodiment disposed in a metal box or a metal recessed groove.
Figure 11:
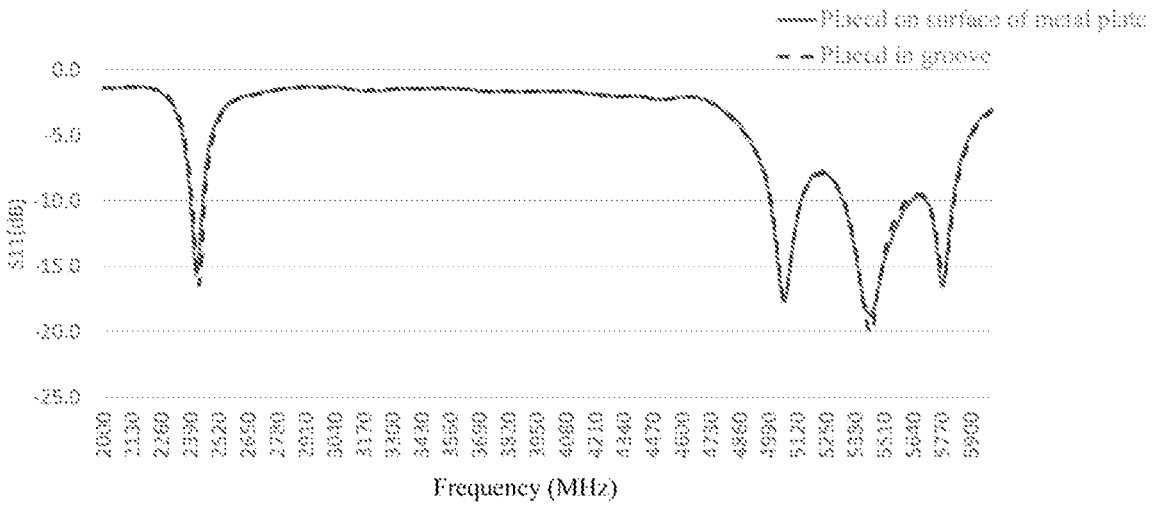
FIG. 11 illustrates radiation performance change of the first embodiment when the first embodiment is disposed on the metal plate surface and when the first embodiment is disposed in the metal box or the metal recessed groove.
Figure 11:
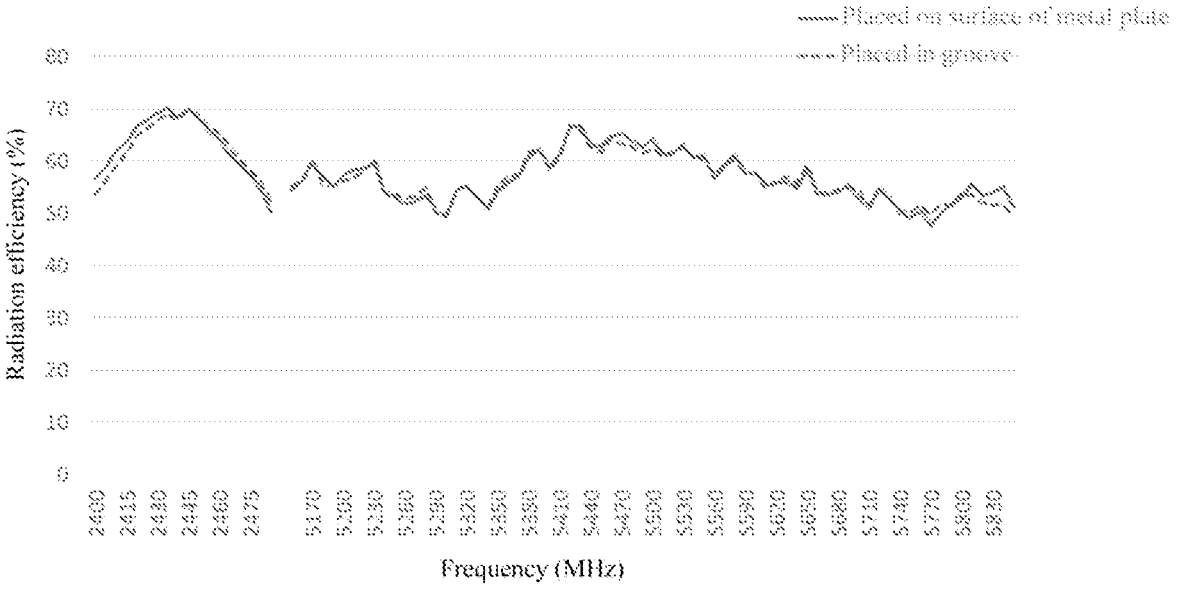

Moreover, referring to FIG. 10, FIG. 10 illustrates an implementing manner that the low profile dual-frequency antenna device of the present embodiment is disposed on a bottom surface 71 in a metal box or a metal recessed groove 7; and referring to FIG. 11, FIG. 11 shows that, when the low profile dual-frequency antenna device of the present embodiment is disposed on the surface of the metal plate 5 and when the low profile dual-frequency antenna device of the present embodiment is disposed in the metal box or the metal recessed groove 7, the return loss of the low profile dual-frequency antenna device of the present embodiment in the resonance frequency (the operating frequency) ranges (for example, at 2.4~2.5 GHz and 5.1~5.9 GHz frequency bands) is low and the radiation efficacy of the low profile dual-frequency antenna device of the present embodiment all is not apparently changed. As can be seen from this, the radiation efficacy of the low profile dual-frequency antenna device of the present embodiment is not affected even a periphery (the side surfaces) of the low profile dual-frequency antenna device is blocked by metal wall surfaces of the metal box or the metal recessed groove 7.

Figure 12:
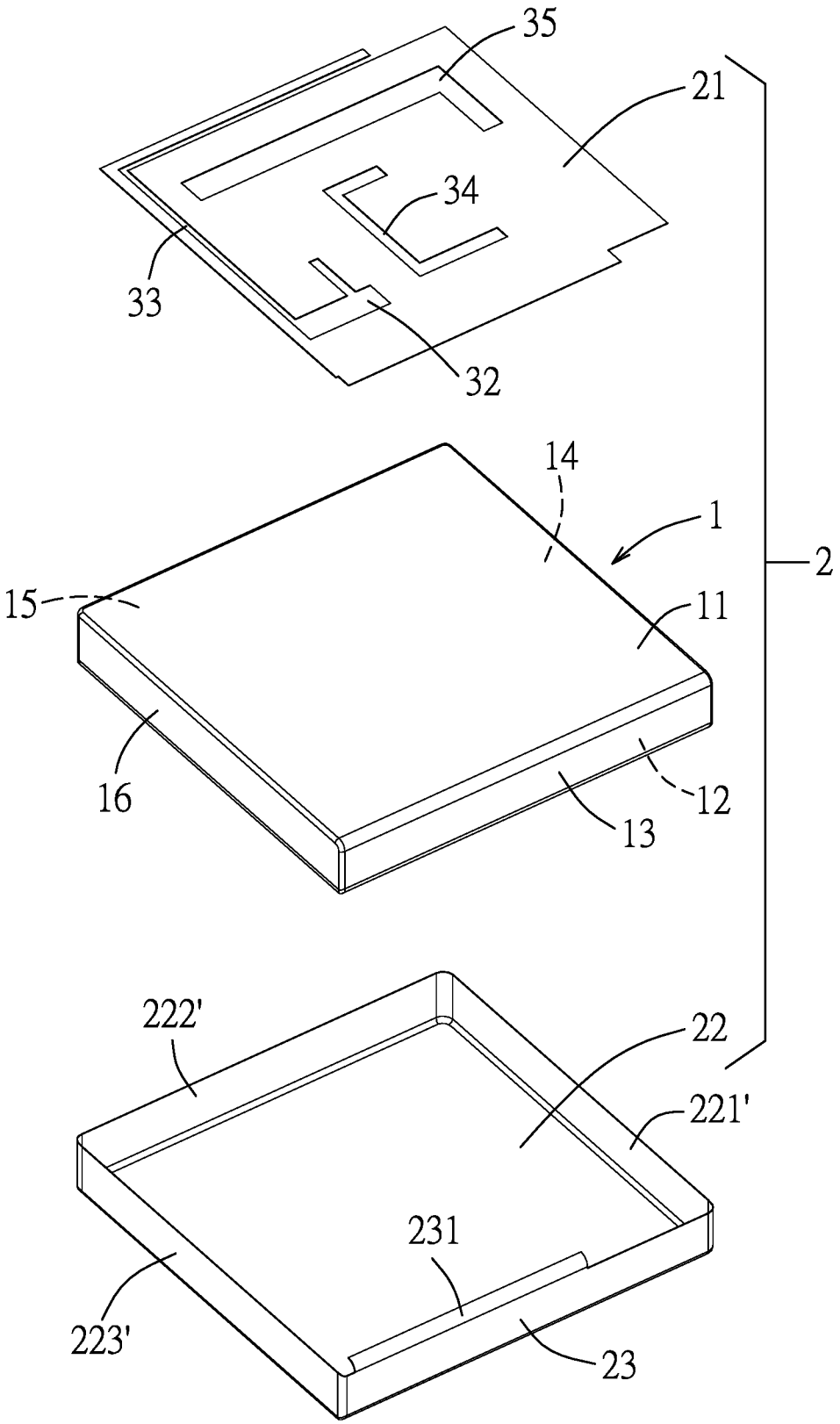
FIG. 12 is a perspective exploded structural schematic view of a second embodiment of the low profile dual-frequency antenna device of the present disclosure.
Figure 13:
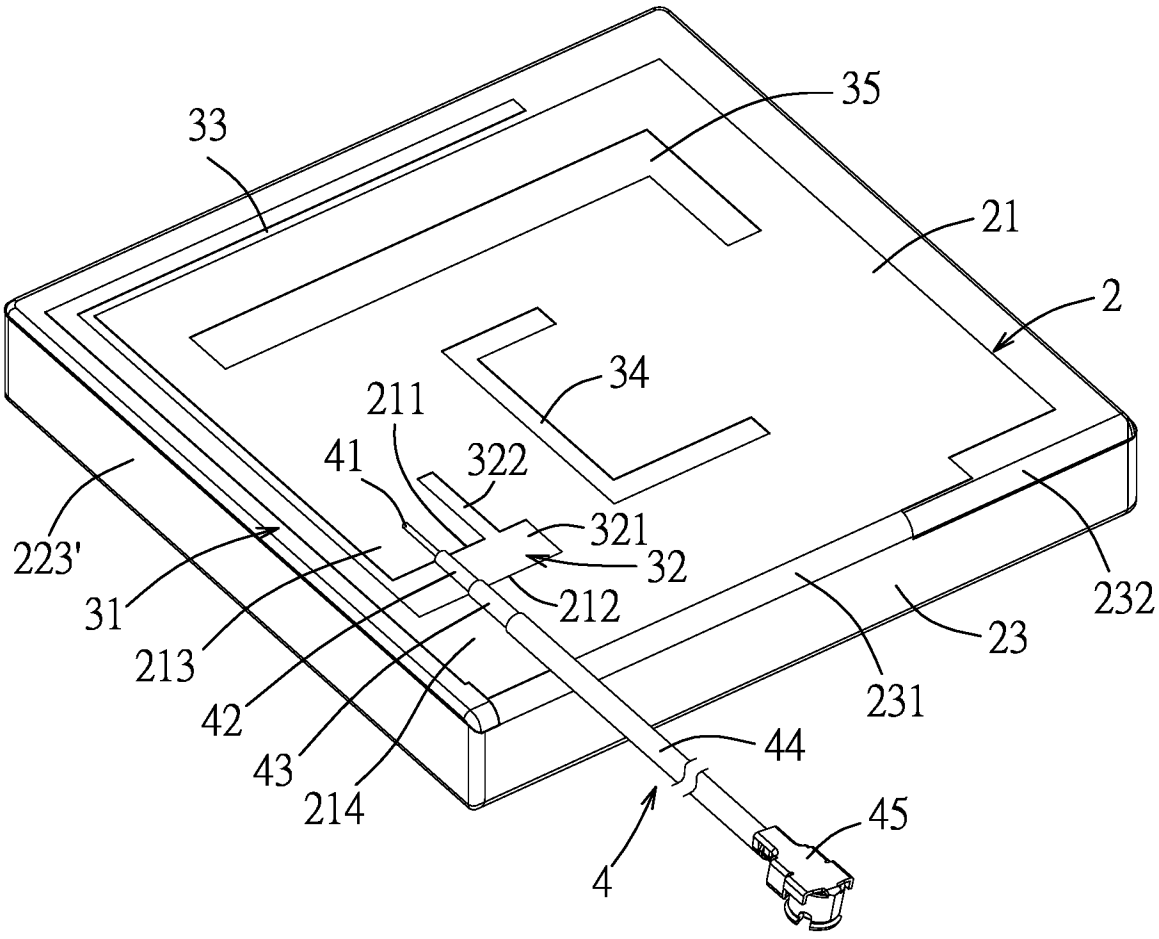
FIG. 13 is a perspective assembled structural schematic top view of the second embodiment.

Further referring to FIG. 12 and FIG. 13, a second embodiment of the low profile dual-frequency antenna device of the present disclosure is illustrated, is the same as the first embodiment in most structures, has only difference in that, three extension portions 221', 222' and 223' of the second conductor 22, which extend respectively from the second surface 12 of the insulative carrier 1 to three side surfaces 14, 15 and 16 except the side surface 13, are connected with each other, and the connection conductor 23 and each of the adjacent extension portions 221' and 223' are connected with each other. Therefore, although the low frequency slot antenna of the present embodiment does not have the first extension slots 311 and the second extension slots 312 of the first embodiment, the low frequency slot antenna of the present embodiment still can adjust the length of the first radiation slot 31 by changing the length of the connection portion 231 which connects the first conductor 21 and the connection conductor 23 (that is, relatively change the length of the slot 232), so that the low frequency slot antenna of the present embodiment can realize the radiation efficacy as the first embodiment.

It is noted that, the extension portions 221(221'), 222 (222') and 223(223') are not all necessarily presented, that is, the second conductor 22 may only include one extension portion which is formed on one of the side surfaces 14~16 or two extension portions which are formed on two of the side surfaces 14~16, for example, the second conductor 22 further include adjacent two extension portions 221(221') and 222(222') or 222(242') and 223(243'); or the second conductor 22 further include single extension portion 221 (221') or 222(222') or 223(223').

In conclusion, in the low profile dual-frequency antenna device of the above embodiments, by that the first radiation slot 31 formed by the conductor unit 2 provided on the insulative carrier 1 constitutes the low frequency slot antenna, and by that the third radiation slot 33, the fourth radiation slot 34 and the fifth radiation slot 35 formed on the first conductor 21 together constitute the high frequency slot antenna, the low frequency slot antenna and a low frequency radio frequency signal can generate resonance to transmit or receive the low frequency radio frequency signal, and the high frequency slot antenna and a high frequency radio frequency signal can generate resonance to transmit or receive the high frequency radio frequency signal, the low profile dual-frequency antenna device can achieve the technical effect and the object that the radio frequency signal at a high frequency band and the radio frequency signal at the low frequency band can be transmitted and received. And, the slot antennas of the low profile dual-frequency antenna device of the above embodiments transmit and receive the radio frequency signal by self-resonance (the slot antenna itself and the radio frequency signal generate resonance) and are independent of the length of the radio frequency transmission line 4 used to transmit the radio frequency signal or the disposing position of the low profile dual-frequency antenna device, so the radiation efficacy of the low profile dual-frequency antenna device will be not affected by the length of the radio frequency transmission line 4 or the disposing position of the low profile dual-frequency antenna device; and the low profile dual-frequency antenna device of the above embodiments may be directly disposed on a metal surface or a bottom surface of a metal recessed groove and the radiation efficacy of the low profile dual-frequency antenna device is not affected, so the low profile dual-frequency antenna device of the above embodiments may operate on a surface of any material, and may be disposed flexibly and easy to install, definitely achieve the technical effect and the object sought by the present disclosure that the low profile dual-frequency antenna device can be applied to a metal surface and has high performance and good stability.

However, what is described above is just the embodiments of the present disclosure, but is not intended to limit the scope implementing the present disclosure, any simple equivalent variations and modifications made according to the claims and the specification of the present disclosure will also be fallen within the scope of the present disclosure.

What is claimed is:

1. A low profile dual-frequency antenna device, comprising:

an insulative carrier having a first surface and a second surface which are opposite; and a conductor unit provided on the insulative carrier and comprising a first conductor and a second conductor, the first conductor being provided to the first surface, the second conductor being provided to the second surface and being connected with the first conductor, a first radiation slot being formed between the first conductor and the second conductor, extending along an edge of the insulative carrier and encircling a periphery of the first conductor; and the first conductor being formed with a second radiation slot, a third radiation slot which is communicated with the first radiation slot and the second radiation slot, a fourth radiation slot and a fifth radiation slot;

the first radiation slot being capable of resonating at a low frequency band to constitute a low frequency slot antenna, the third radiation slot, the fourth radiation slot and the fifth radiation slot being capable of resonating at a high frequency band to together constitute a high frequency slot antenna, the second radiation slot deciding an impedance and a resonance frequency width of the low frequency slot antenna and an impedance and a resonance frequency width of the high frequency slot antenna; and a first side edge and a second side edge being oppositely positioned at a location where the second radiation slot and the third radiation slot are communicated, and the first conductor having a signal feeding-in portion thereon close to the first side edge, the first conductor having a ground portion thereon close to the second side edge.

2. The low profile dual-frequency antenna device as claim 1, wherein the insulative carrier is rectangular to have four side surfaces which connect the first surface and the second surface, and the conductor unit further comprises a connection conductor, the connection conductor is provided to one side surface of the four side surfaces which is close to the second side edge, and the connection conductor connects the first conductor and the second conductor.

3. The low profile dual-frequency antenna device as claim 2, wherein the second conductor further comprises at least one extension portion which extends from the second surface to at least one side surface of the three side surfaces except the one side surface providing the connection conductor.

4. The low profile dual-frequency antenna device as claim 3, wherein the second conductor further comprises three extension portions which respectively extend from the second surface to the three side surfaces except the one side surface providing the connection conductor, a first extension slot is formed between every two adjacent extension portions and is communicated with the first radiation slot, a second extension slot is formed between the connection conductor and each of the extension portions adjacent to the connection conductor and is communicated with the first radiation slot, and the low frequency slot antenna comprises the first extensions slot and the second extension slots.

5. The low profile dual-frequency antenna device as claim 3, wherein the second conductor further comprises three extension portions which respectively extend from the second surface to the three side surfaces except the one side surface providing the connection conductor, every two adjacent extension portions are connected with each other, and the connection conductor and each of the extensions portions adjacent to the connection conductor are connected with each other.

6. The low profile dual-frequency antenna device as claim 1, wherein the low profile dual-frequency antenna device further comprises a radio frequency transmission line, the radio frequency transmission line comprises an inner conductor, an inner insulative layer, an outer conductor and an outer insulative layer which are provided from the inside to the outside, one end of the inner conductor is electrically connected with the signal feeding-in portion, one end of the outer conductor which is positioned at one same side of the radio frequency transmission line as the inner conductor is electrically connected with the ground portion, and the radio frequency transmission line further comprises a connection terminal provided to the other side of the radio frequency transmission line.

7. The low profile dual-frequency antenna device as claim 1, wherein a length of the first radiation slot can decide a resonance frequency of the low frequency slot antenna, lengths of the third radiation slot, the fourth radiation slot and the fifth radiation slot can decide a resonance frequency of the high frequency slot antenna, a length and a width of the second radiation slot can decide an impedance and a resonance frequency width of the low frequency slot antenna and an impedance and a resonance frequency width of the high frequency slot antenna.

8. The low profile dual-frequency antenna device as claim 1, wherein the low profile dual-frequency antenna device can be disposed on a metal surface by a manner that the first conductor is toward the up.

9. The low profile dual-frequency antenna device as claim 1, wherein the low profile dual-frequency antenna device can be disposed in a metal box or a metal recessed groove by a manner that the first conductor is toward the up.

* * * * *